US005508515A

United States Patent [19]

Enge

[11] Patent Number: 5,508,515

[45] Date of Patent: Apr. 16, 1996

[54] MASS RECOMBINATOR FOR ACCELERATOR MASS SPECTROMETRY

[76] Inventor: Harald A. Enge, 20 Nason Hill Rd., Sherborn, Mass. 01770

[21] Appl. No.: 398,758

[22] Filed: Mar. 6, 1995

[51] Int. Cl.[6] ..... H01J 49/30

[52] U.S. Cl. ..... 250/281; 250/298; 250/396 ML

[58] Field of Search ..... 250/281, 288, 250/298, 396 ML

[56] References Cited

U.S. PATENT DOCUMENTS

| | | | |
|---|---|---|---|
| 3,243,667 | 3/1966 | Enge | 317/200 |
| 4,425,506 | 1/1984 | Brown et al. | 250/396 ML |
| 5,013,923 | 5/1991 | Litherland et al. | 250/396 R |
| 5,118,936 | 6/1992 | Purser | 250/281 |

*Primary Examiner*—Jack I. Berman

*Attorney, Agent, or Firm*—Nields & Lemack

[57] ABSTRACT

A mass recombinator comprises a source of negative ions to be analyzed. These negative ions are accelerated to roughly the same moderate kinetic energy and electrostatically focused to a substantially parallel beam which enters the magnetic field of a dipole magnet at an angle of incidence. The field of the dipole magnet is designed to deflect a substantially parallel beam of negative ions having the same energy and entering at a specified angle of incidence in such a manner that it describes a loop of approximately 264.6 degrees, forming a mass spectrum at a position inside the magnet after deflection of approximately 132.3 degrees. The beam exits the field as a parallel beam substantially where it entered, independent of the mass of the ions. Means are provided at the position of the mass spectrum to block ions of certain mass numbers and to allow others to pass, the passed ions being reassembled and exiting the magnet as a parallel beam substantially where it entered, independent of the mass numbers of the ions.

10 Claims, 3 Drawing Sheets

MASS RECOMBINATOR FOR ACCELERATOR MASS SPECTROMETRY

FIELD OF THE INVENTION

The present invention relates to accelerator mass spectrometry which generally utilizes a system consisting of a negative ion source, a mass pre-selector, a Tandem Electrostatic Accelerator and a final isotope separator. The pre-selector serves to reduce the amount of spurious negative ions that enter the Tandem Accelerator. The stripping canal of the Tandem serves the important function of breaking up negative molecular ions in such a manner that only atomic species (with positive charge) continue. The isotope separator (mass selector) finally determines the relative intensities of the selected atomic species.

The present invention describes an electromagnetic system which is to be used as the pre-selector of negative ions of certain mass numbers to be injected into the Tandem accelerator. Another solution to the same problem is described in U.S. Pat. No. 5,013,923 to Litherland et al. entitled "MASS RECOMBINATOR FOR ACCELERATOR MASS SPECTROSCOPY", reference to which is hereby made for prior art disclosures of mass recombinators.

DESCRIPTION OF THE RELATED ART

The age of ancient organic materials can in many cases be determined by measuring the abundance ratio of Carbon-14 to Carbon-13 or to Carbon-12. This is because in living organisms these ratios are in equilibrium with those in the atmosphere, but after the organic material dies, the content of radioactive Carbon-14 decays with a halflife of 5730 years. Similarly, isotope ratios in certain minerals can be used to determine the geological lifetime of those minerals. Accelerator mass spectrometry may also be used to measure small quantities of trace elements in certain materials such as silicon.

Several large Tandem Accelerators, designed for Nuclear Physics research, have been used for dating various materials by determination of isotope ratios. Lately, smaller, dedicated facilities have been put into operation for this purpose.

Most often, the isotope abundance ratios of interest are exceedingly small, as in the case of the ratio for $^{14}C$ to $^{12}C$. As indicated in said U.S. Pat. No. 5,013,923, such ratios may be of the order of one part per trillion ($10^{-12}$). To increase the accuracy of the measurements, it is generally necessary to make a pre-selection of masses, before the accelerator, and then make a final measurement of the ratios in an isotope separator after acceleration and charge exchange in the Tandem.

In principle it is possible to utilize other accelerators for the purpose herein discussed. However, a dc Tandem accelerator powered by a charged belt (Van de Graaff generator) or by other means, e.g. a cascade rectifier circuit, is ideally suited for the purpose, partially because of the voltage stability of these machines. Therefore, hereinafter the accelerator will continue to be referred to as the Tandem.

SUMMARY OF THE INVENTION

The present invention relates to the pre-selection process. The pre-selector is composed of a 264.6-degree non-uniform dipole magnet with a prescribed non-uniform field, bracketed by two electrostatic lenses or lens systems. The lenses may be electrostatic Einzel lenses or electrostatic quadrupole pairs or triplets, all devices that are well known to workers in the field. The function of the lens system on the entrance side is to present to the dipole magnet a substantially parallel beam, and on the exit side the function of the lens system is to match a parallel beam emerging from the dipole magnet to the entrance of the accelerator tube of the Tandem for optimum transmission, again with purely electrostatic devices. On the entrance side the focusing function may be combined with the accelerating function designed to bring the negative ions up to the desired kinetic energy.

The dipole magnet has a well-defined non-uniform field and all negative ions entering the dipole parallel to the central orbit make a 264.6-degree deflection, independent of mass or energy. Assuming that the ions have the same charge and energy, the orbit amplitude inside the magnet is a function of the mass, and this makes it possible to make a mass selection in the middle of the magnet where a mass spectrum is formed. The magnet is very similar to that described in U.S. Pat. No. 3,243,667 to Enge entitled "NON DISPERSIVE MAGNETIC DEFLECTION APPARATUS AND METHOD", the disclosure of which is hereby incorporated herein by this reference thereto. The central ray for a given mass describes a loop with the entrance and exit points coinciding. The magnet is therefore sometimes referred to as a "Pretzel" magnet. The amplitude of the loop inside the magnet increases monotonically (but nonlinearly) with the mass of the ions. The gradient and angle of incidence in the version discussed here have been selected to produce parallel-to-parallel focusing in both planes, as mentioned above. The magnet disperses a negative ion beam into a mass spectrum in the middle after 132.3-degree deflection. It then re-assembles all species, not purposely blocked, to a parallel beam at the exit, after 264.6 degree deflection.

If the magnet is made large and powerful enough, the mass spectrum along the symmetry line may cover the isotopes of all elements from hydrogen to uranium carrying a charge of −1 electronic units. A selection of masses can be made by a mask with slits or holes at the appropriate places. One can envision dedicated masks made for specific investigations, for instance, a mask with three holes positioned to allow all ions with charge state −1 and masses 12, 13, and 14 to pass. Such a mask may comprise a sheet of metal or other material placed at the position inside the magnet at which the ions arrive after deflection of approximately 132.3 degrees.

Since all ions of charge state −1 leave the ion source and pre-accelerator with substantially the same kinetic energy, they can all be substantially focused from point (waist) at the source to parallel at the Pretzel entrance with electrostatic means, as mentioned above. At the exit of the dipole they can be refocused, again with electrostatic means, to a waist positioned to match the ion optics properly to the entrance of the Tandem acceleration tube.

Heretofore the Pretzel magnet has most often been used to deflect an electron beam 270 degrees (effectively 90 degrees) independent of the momentum of the electrons. This type of Pretzel produces in effect a parallel-to-parallel transfer in the median plane (with an inside crossover) and parallel-to-converging transfer in the transverse direction (with an inside crossover.)

In the present case the angle of incidence into the magnetic field—and the field distribution—are both changed slightly, resulting in a tighter loop, but more importantly, a parallel-to-parallel transfer in both planes independent of the momentum of the particles. It is assumed that the particles have the same sign of charge and, of course, that the momentum divided by charge does not exceed an upper limit.

In accordance with the present invention negative ions—atoms—all with the same charge and the same kinetic energy, but different masses, form a beam diverging from a small opening at the exit of a negative ion source, are accelerated to a fixed kinetic energy and are focused by electrostatic means to a parallel beam which then is directed into the Pretzel magnet. The beam is dispersed inside the Pretzel according to mass but emerges as a single parallel beam and can, if desired, be focused again by electrostatic means to a single small waist, independent of the masses of the particles. An important point here is that the focusing action of electrostatic lenses depends upon E/q (kinetic energy over charge) and is independent of particle mass. Therefore, the complete system can transfer a mixed beam of particles with the same energy and charge, but with different masses, from point to point while being dispersed somewhere en route such that a selection of masses can be made. Furthermore, there is no limit to the range of masses that can be handled by this system, e.g. the range of hydrogen to uranium.

BRIEF DESCRIPTION OF THE DRAWINGS

The invention may best be understood from the following detailed description thereof, having reference to the accompanying drawings, in which.

DESCRIPTION OF THE PREFERRED EMBODIMENT

Figure 1:
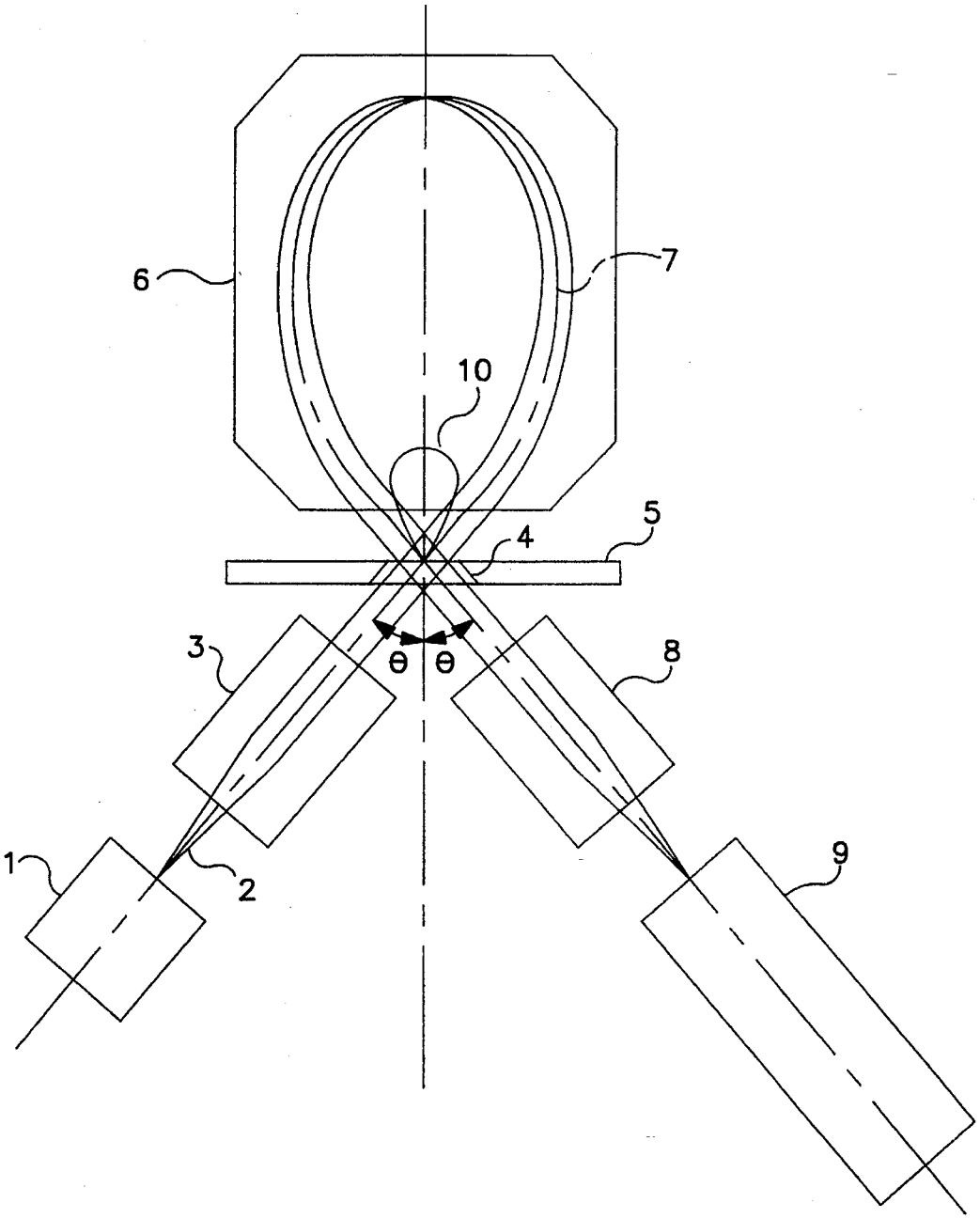
FIG. 1 is a somewhat diagrammatic horizontal section showing the general layout of a preferred embodiment of the "Pretzel" Recombinator of the invention.

FIG. 1 is a general layout of the components of the system. It is, of course, generally understood, that the beam or beams always travel through vacuum, although no vacuum enclosure is shown on the drawing.

Referring now to FIG. 1, an ion source 1 produces a beam 2 of negative ions which is rendered substantially parallel by an electrostatic cylindrical Einzel lens 3 or other electrostatic focusing device, such as an electrostatic quadrupole pair or triplet.

The ion beam passes through an opening 4 in a "mirror" plate 5 which defines a vertical plane in which the vertical component of the magnetic field is substantially zero. It is then deflected in the field of the magnet, one pole face of which, the South pole face 6, is shown. After describing a loop 7 the beam exits again through the hole 4, is focused by the electrostatic lens system 8 which matches it to the entrance ion optics of the Tandem accelerator tube 9.

The depth of penetration into the magnet is a very non-linear function of mass. For instance, if orbit 7 in FIG. 1 represents mass number 200, orbit 10 represents mass number 1.

The magnetic field in the median (horizontal) plane can be expressed as a function of the distance z from the mirror plate as $$B=B_0(z/a)^n \qquad \text{(Eq. 1)}$$

Clearly a is a depth parameter—the distance from the mirror plate at which point $B=B_0$.

Off the median plane, the magnetic field, calculated by expansion from the field in the median plane (Eq. 1), diverges as z approaches zero, except for the case n=1. Mathematically, this problem is circumvented by making n=1 in a narrow zone close to the mirror plate, i.e. for small values of z. In practice, the field in the region of the entering beam is, of course, very weak, and the discontinuity between the two zones of slightly different field description is of little consequence.

With an index n equal to n=0.924 a beam entering at an angle θ equal to 42.3 degrees is deflected by 264.6 degrees and exits at the point of entry. It is clear from FIG. 1 that the angle θ is the angle made by the incident beam with respect to the normal to the mirror plate 5, so that the incident angle with respect to the mirror plate 5 is (90–42.3) or 47.7 degrees. It is obvious from the symmetry of the system that, in the median plane a parallel beam experiences a cross-over, that is, it goes through a point on the z-axis, and emerges as a parallel beam, independent of the mass of the ion. For the vertical direction, detailed calculations with the aid of the program RAYTRACE show that, for the particular choice made of n-value and incident angle, the transfer of a parallel beam also goes through a parallel-to-point-to-parallel transfer of the vertical displacement, independent of the mass of the ion.

The values of 0.924 for n, 264.6 degrees for total deflection, 132.3 degrees for the location of the symmetry line and 47.7 degrees for the angle of incidence are optimum values, and slight deviations therefrom may be tolerated depending upon the nature of the particular application.

The mirror plate, is described above as necessary for producing the required distribution of the magnetic field for perfect performance. It may be possible to replace it with compensating coils or, in some cases, leave it out, altogether. The latter solution certainly will limit the range of masses of the ions that are correctly or nearly correctly focused.

Figure 2:
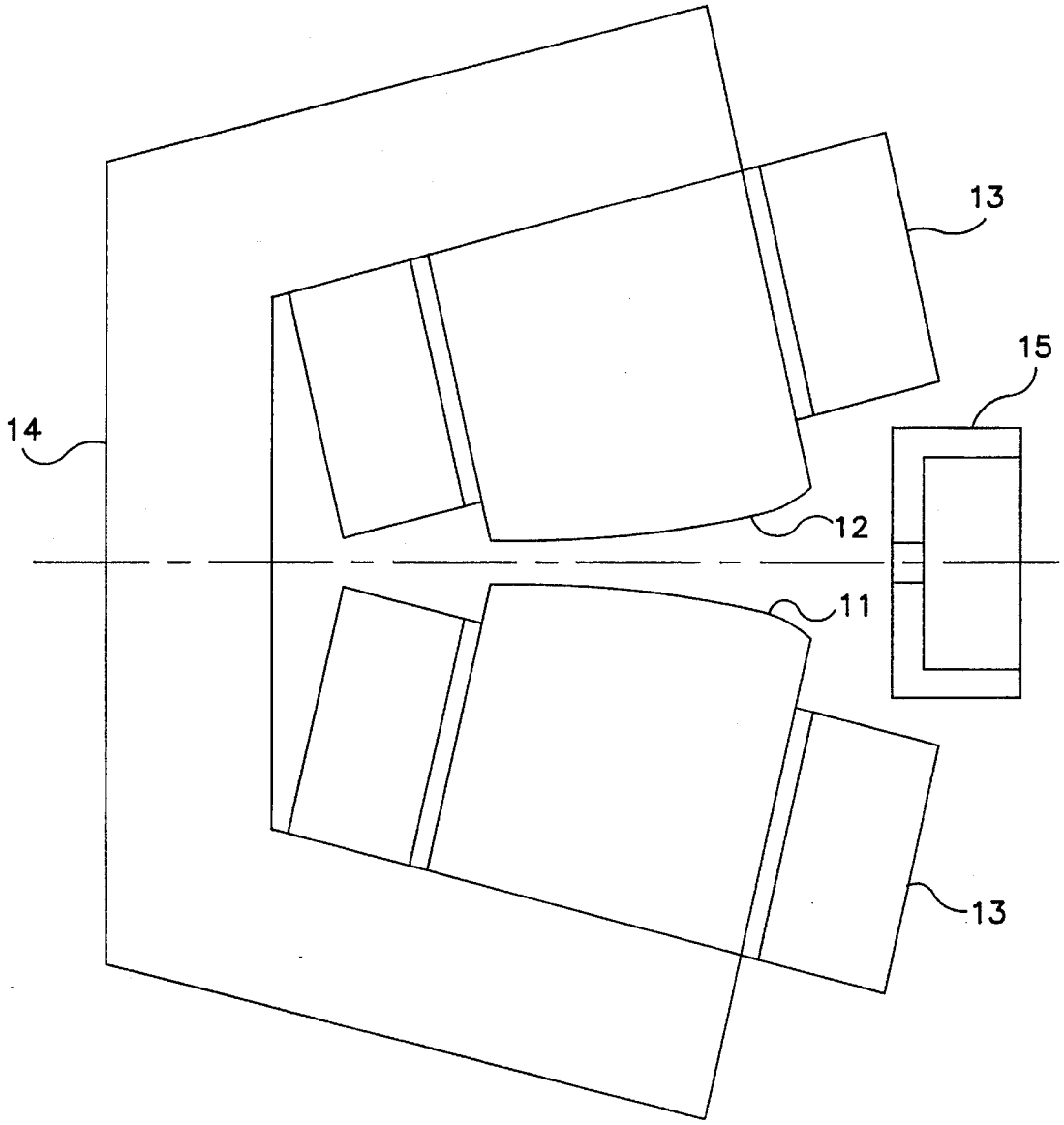
FIG. 2 is a somewhat diagrammatical cross-sectional side view of the "Pretzel" magnet taken along the vertical symmetry plane.
Figure 3:
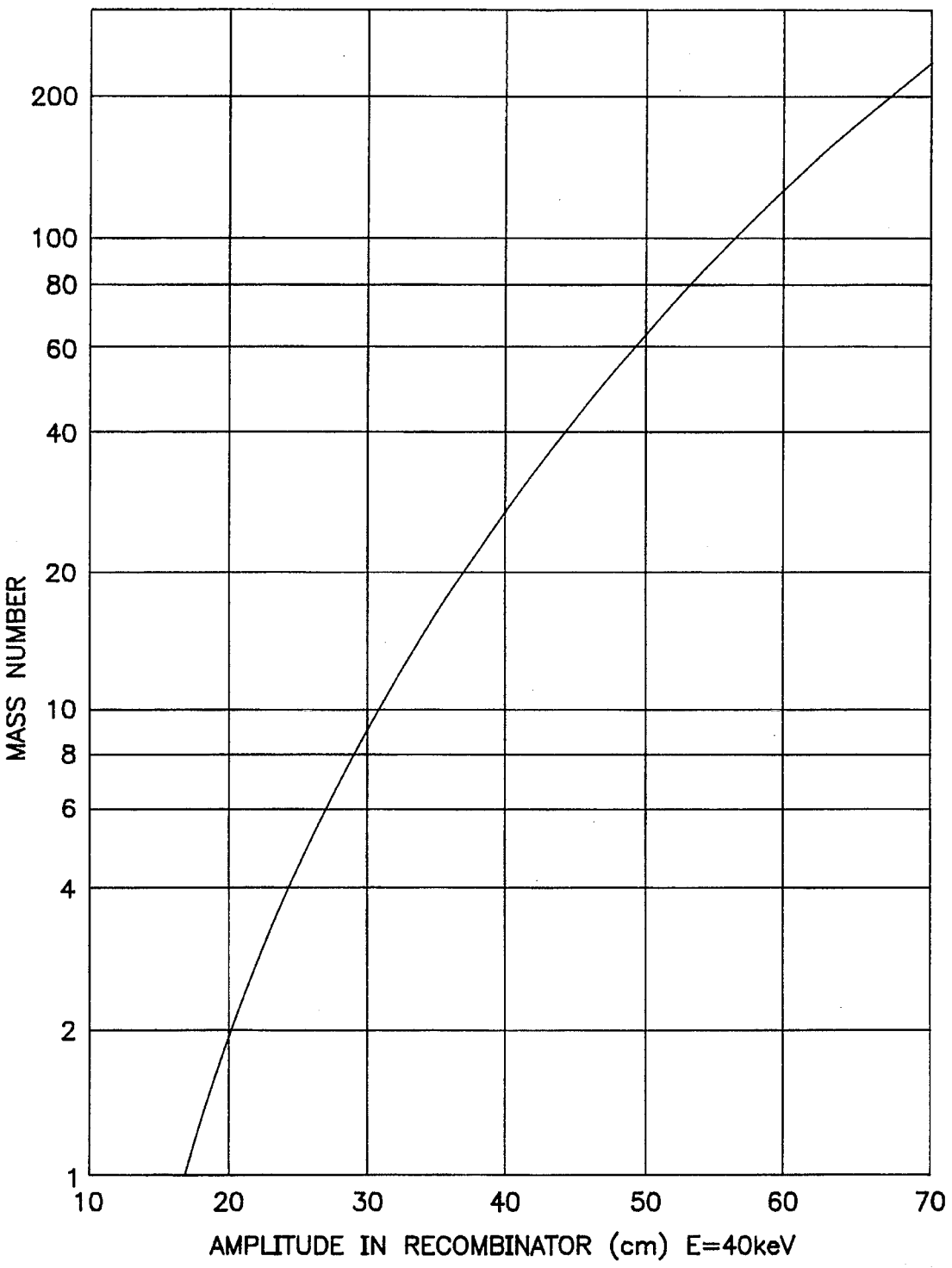
FIG. 3 is a graph showing a typical case of position versus mass along the vertical midplane of the "Pretzel" magnet of FIGS. 1 and 2 for ions of charge state −1 and 40-keV energy.

FIG. 2 is a vertical cut through the magnet of FIG. 1 with South pole 11 (corresponding to South pole 6 of FIG. 1), North pole 12, coils 13, yoke 14, and mirror 15. In this example the mirror plate 5 of FIG. 1 has been replaced by a ferromagnetic channel 15 which provides better shielding for the beam in the presumed field free region in front of the magnet.

Having thus described the principles of the invention, together with illustrative embodiments thereof, it is to be understood that although specific terms are employed, they are used in a generic and descriptive sense, and not for purposes of limitation, the scope of the invention being set forth in the following claims.

I claim:

1. A mass recombinator comprising in combination (a) a source of negative ions to be analyzed, (b) means for accelerating negative ions from said source as a beam to substantially the same moderate kinetic energy, (c) electrostatic means for focusing said negative-ion beam to a substantially parallel beam, (d) a dipole magnet having a field pattern designed to deflect a substantially parallel beam of negative ions having substantially the same moderate kinetic energy which is injected into said field pattern at a specified angle of incidence in such a manner that it describes a loop of approximately 264.6 degrees forming a mass spectrum at a position inside the magnet after deflection of approximately 132.3 degrees, and to make the beam exit said field pattern as a parallel beam substantially where it entered, independent of the mass of the ions, (e) means for directing said parallel beam into said field pattern at said angle of incidence, and (f) means of blocking ions of certain mass numbers at the position of the mass spectrum and allowing others to pass, the passed ions being reassembled and exiting the magnet as a parallel beam substantially where it entered, independent of the mass numbers of the ions.

2. A mass recombinator in accordance with claim 1, wherein said means for accelerating negative ions includes said electrostatic means for focusing said negative-ion beam.

3. A mass recombinator comprising in combination a dipole magnet having a base line and having a field pattern substantially in accordance with the formula $B=B_0(z/a)^n$ in which z is the distance from the base line, n=0.924 and $B_0$ and a are other constants, a source of negative ions to be analyzed, means for accelerating negative ions from said source to substantially the same moderate kinetic energy as a beam, electrostatic means for focusing said negative-ion beam to a substantially parallel beam, and means for directing said parallel beam into said field pattern through said base line at an angle of about 47.7 degrees with respect to said base line, whereby said beam of negative ions is deflected in such a manner that it describes a loop of approximately 264.6 degrees forming a mass spectrum at a position inside the magnet after deflection of approximately 132.3 degrees and exits the field as a parallel beam substantially where it entered, independent of the mass of the ions, and means of blocking ions of certain mass numbers at the position of the mass spectrum and allowing others to pass, the passed ions being reassembled and exiting the magnet as a parallel beam substantially where it entered, independent of the mass numbers of the ions.

4. A mass recombinator in accordance with claim 1, including a plate or other device made of high-permeability material and designed so as to define a plane where the vertical component of the magnetic field is substantially zero, said plate or other device having a hole through which the negative ions are injected and extracted.

5. A mass recombinator in accordance with any one of claims 1 through 4, in which the required field distribution is produced by an appropriate shape of the pole pieces.

6. A mass recombinator in accordance with any one of claims 1 through 4, in which the required field distribution is produced by appropriate surface windings on the poles.

7. A mass recombinator in accordance with claim 1 and having further electrostatic focusing means to match the beam optics to the entrance of the electric field of an accelerator.

8. A mass recombinator in accordance with claim 1 in which said electrostatic means for focusing said negative ions is an electrostatic Einzel lens.

9. A mass recombinator in accordance with claim 1 in which said electrostatic means for focusing said negative ions is an electrostatic quadrupole pair.

10. A mass recombinator in accordance with claim 1 in which said electrostatic means for focusing said negative ions is an electrostatic quadrupole triplet.

* * * * *